US007040907B2

(12) United States Patent
Uchida

(10) Patent No.: US 7,040,907 B2
(45) Date of Patent: May 9, 2006

(54) ELECTRIC PLUG

(75) Inventor: Shinji Uchida, Kanagawa (JP)

(73) Assignee: J. S. T. Mfg. Co., Ltd., Osaka (JP)

( * ) Notice: Subject to any disclaimer, the term of this patent is extended or adjusted under 35 U.S.C. 154(b) by 4 days.

(21) Appl. No.: 10/784,223

(22) Filed: Feb. 24, 2004

(65) Prior Publication Data

US 2004/0229483 A1 Nov. 18, 2004

(30) Foreign Application Priority Data

Feb. 25, 2003 (JP) ..... 2003-048126

(51) Int. Cl.
*H01R 13/44* (2006.01)

(52) U.S. Cl. ..... 439/141

(58) Field of Classification Search ..... 439/140, 439/141, 136, 137, 660, 131
See application file for complete search history.

(56) References Cited

U.S. PATENT DOCUMENTS 3,673,545 A * 6/1972 Rundle ..... 439/248
6,733,311 B1 * 5/2004 Kameda ..... 439/140
2004/0132325 A1 * 7/2004 Yu et al. ..... 439/140

FOREIGN PATENT DOCUMENTS

| | | | |
|---|---|---|---|
| JP | 05-074527 | A | 3/1993 |
| JP | 10-041028 | A | 2/1998 |
| JP | 11-177670 | A | 7/1999 |
| JP | 11-266088 | A | 9/1999 |
| JP | 11-354203 | A | 12/1999 |

* cited by examiner

*Primary Examiner*—Javaid H. Nasri
(74) *Attorney, Agent, or Firm*—Rader, Fishman & Grauer PLLC

(57) ABSTRACT

A miniature multi-polar electric plug which can prevent the male contacts from being placed unprotected all the time is provided. An electric plug (10) has a plug housing (1), male contacts (2), a shutter (3), a shell (4), and a pair of compressed coil springs (5). The plug housing (1) has a header part (1*a*) and a frame part (1*b*). The header part (1*b*) protrudes from the frame part and has a mounting board (12) for mounting the male contacts (2) and the shutter (3). The compressed coil springs (5) move the shutter (3) to cover or uncover the male contact (2).

9 Claims, 7 Drawing Sheets

ELECTRIC PLUG

CROSS-REFERENCE TO RELATED APPLICATIONS

This application is based upon and claims the benefit of priority from the prior Japanese Patent Application No. 2003-048126 filed on Feb. 25th in 2003, the entire contents of which is incorporated herein by reference.

FIELD OF THE INVENTION

The present invention relates to an electric plug for electrical connecting.

BACKGROUND OF THE INVENTION

The recent electronic devices such as cellular phones, micro video cameras, and portable information terminals use a connection base designated as a cradle (also referred to as a docking station) for sending and receiving data to and from desk top personal computers.

The cradle mounts a plug thereon and is connected with a cable via which the cradle and a desk top personal computer are connected to each other. On the other hand, electronic devices such as portable information terminals have a receptacle, and the receptacle provided on the electronic device can be connected with the plug provided on the cradle to secure high speed data transfer between the electronic device and the desk top personal computer. One of the simplest forms of the cradle is a charger for cellular phones.

Conventionally, this kind of cradle is unique to electronic devices connected with the cradle. However, highly versatile cradles equipped with a connector connectable with various kinds of connectors of cellular phones have been invented (Japanese Published Unexamined Patent Application No. H11-177670).

In the above-described invention, the cradle includes a holding rail for holding a cellular phone and a connector connected with a connector of the cellular phone. The connector of the cradle is held on the cradle in such a manner as to be movable up and down, back and forth and around via springs.

With this structure, even when there is a relative displacement between the connector of the cellular phone and the connector of the cradle, the connector of the cradle can freely move to be engaged with the connector of the cellular phone.

However, the provision of the above-described connector to the cradle increases the number of components of the cradle. It is simpler in structure to directly engage the receptacle connector provided on the electronic device with the plug connector provided on the cradle side.

The interface connector (or an I/O connector) mounted on such a cradle is generally a multi-polar dual in-line connector having two rows of contacts. In the dual in-line plug, the dual in-line contacts are surrounded by insulative fixed vertical walls protecting the contacts from being direct touched by a hand. Such a dual in-line plug is so-called four-wall shrouded, thereby having a large outer size.

However, electronic devices (micro video cameras, for example) to be connected with a cradle having a dual in-line plug are increasingly being reduced in size, which inevitably requires size reduction in a dual in-line receptacle provided for the above-described electronic devices. For this reason, it has been sought to miniaturize a dual in-line plug installed in the cradle, leaving almost no room for the formation of insulative fixed vertical walls surrounding the contacts (the so-called no wall header).

However, even if a dual in-line plug is miniaturized until there is no room left for insulative surrounding walls, when the contacts placed unprotected are subjected to dust or handling, it may become an indirect cause of a contact failure of the contacts. For this reason, dustproof measures have been sought for miniaturization of the dual in-line plug.

Furthermore, when security is taken into consideration, it is preferable to array dual in-line female contacts of fixed contacts in a dual in-line receptacle provided on an electronic device, and to array male contacts of flexible leaf springs in a dual in-line plug provided on a cradle, since the female contacts receive a contact pressure from the male contacts.

In other words, as compared with the fixed contacts which receive the contact pressure, the male contacts which give the contact pressure tend to be comparatively short-lived as a result of repeated insertion and removal of the connector. For this reason, it is not preferable to provide the short-lived male contacts to the connector mounted on the electronic device because it requires disassembling partially the electronic device in order to replace the connector.

Therefore, when the replacing the connector is taken into consideration, it is preferable to mount the dual in-line plug connector having male contacts of short-lived flexible leaf springs on the cradle. This holds true of cable connectors, without being limited to cradle connectors.

In order to solve the above-described problems, the present invention has an object of providing a miniature multi-polar electric plug which can prevent the contacts from being placed unprotected all the time.

SUMMARY OF THE INVENTION

The inventors have invented the following new electric connection plug to accomplish the above-mentioned object.

(1) An electric plug comprising: an insulative plug housing having a frame part and a header part which has a mounting board and is formed integrally with the frame part to be protruded from the frame part and inserted into a mating receptacle; male contacts of flexible leaf springs each having a flexible top part, wherein the male contacts are arrayed in parallel on both surfaces of the mounting board for mounting the male contacts, and a pair of the flexible top parts of the male contacts opposed to each other with the mounting board disposed therebetween are raised towards opposite directions to each other; and a shutter which covers the male contacts when the header part is removed from the mating receptacle and is housed in the frame part by being pushed by the mating receptacle so as to expose the male contacts when the header part is inserted into the mating receptacle.

The invention described in (1), the shutter formed as thin walls surrounds the male contacts instead of insulative fixed vertical walls, thereby realizing miniaturization of the electric plug and a mating receptacle. When the electric plug is not inserted into the mating receptacle, the shutter covers the male contacts making it impossible to easily touch the male contacts. On the other hand, when the electric plug is inserted into the mating receptacle, the shutter is retracted to make the male contacts contact with female contacts of the mating receptacle which surrounds the male contacts, thereby making it impossible to easily touch the male contacts.

According to the invention described in (1), thin leaf springs are used for the male contacts instead of the conventional pin connection to connect the receptacle and the plug, thereby realizing miniaturization of the plug.

(2) The electric plug according to (1) further comprising an elastic member for pushing out the shutter to cover the male contacts when the header part is removed from the mating receptacle.

According to the invention described in (2), when the electric plug is not inserted in the mating receptacle, the shutter is moved by a force caused by the elastic member to shield the male contacts from outside, thereby protecting the male contacts from dust or handling. The elastic member can be a compressed coil spring, for example.

(3) The electric plug according to (1) or (2), wherein the mounting board has a top board, a distance between the flexible top parts opposed to each other with the mounting board disposed therebetween is slightly larger than a width of the top board to make the male contacts press female contacts of the mating receptacle.

(4) The electric plug according to any one of (1) to (3) wherein legs of the male contacts opposed to each other with the mating board disposed therebetween extend from the header part towards opposite directions to each other to be fixed on a printed-circuit board.

According to the invention described in (4), the contacts can be arrayed in a small pitch by mounting them in the positioning pattern on the surface of the printed-circuit board.

(5) The electric plug according to any one of (1) to (4) further comprising: a shell for covering the frame part; and pairs of soldering tabs arranged in edges of the shell to be fixed on the printed-circuit board.

The electric plug of the invention described in (5) can be mounted on the printed-circuit board like a surface mounting device.

(6) The electric plug according to any one (1) to (4), wherein the shell is formed of a metal thin plate, covers the frame part and has protruding pieces to cover a part of the header part.

According to the invention described in (6), the frame part is covered with the shell formed of the metal thin plate which reinforces the frame part structurally, and at the same time, shields the plug. Since the shell has the protruding pieces to partially cover the header part, when the plug is inserted into the mating receptacle, the mating receptacle and the plug are integrally shielded.

(7) The electric plug according to any one of (1) to (6), wherein the shutter has a first shutter wall and a second shutter wall which are opposed to each other with the male contacts disposed therebetween; each of the first shutter wall and the second shutter wall has a pair of restricting frames on both flanks thereof; each of the restricting frames has a groove, each of the surfaces of the mounting board for mounting the male contacts is provided with a pair of rails on opposite edges of the surface, and the rail is engaged with the groove in such a manner where the shutter can move back and forth.

According to the invention described in (7), the rails shaped in letter of L are engaged in the grooves shaped in letter of U, which secures the parallel movement of the shutter thereby preventing the shutter from opening unnecessary.

(8) An electric plug according to any one of (1) to (7) being installed in a cradle via the printed-circuit board.

(9) An electric plug according to any one of (1) to (7) being installed in a cable via the printed-circuit board.

(10) A receptacle capable of being connected with the electric plug according to any one of (1) to (9).

The "insulative plug housing" can be assumed to be a plug housing made from a material electrically isolated, and to have the feature of holding and protecting the male contacts with an electrically insulating member.

The phrase "the header part and the plug frame part are integrally formed" indicates that the plug housing can be integrally molded with an electrically insulative synthetic resin material. After the plug housing is integrally molded using a synthetic resin material, it can be processed mechanically in parts. Furthermore, the plug can be formed by cutting process.

The male contacts in this invention are preferably leaf springs so as to be arrayed in a small-pitch of about 0.5 mm. When a pin is used as the male contact instead of the leaf spring, a slit socket pin corresponding to the contact pin must have some outer diameter, which makes it difficult to array the male contacts in a small pitch of 0.5 mm or so.

The number of poles of the male contacts to be arrayed is preferably 40 or more when the electric plug is used as an interface connector. In other words, as many as 20 male contacts can be arrayed in parallel on one surface of the mounting board, and 13 male contacts can be arrayed in parallel on one surface to make 26 poles as a whole depending on the application of the plug connector.

The "insulative shutter" can be assumed to be a shutter made from a material electrically isolated, and to have a function of isolating the male contacts with an electric insulator. Unless when the plug is connected with the mating receptacle, the shutter can be assumed to cover the male contacts so as to isolate the male contacts from outside.

The shutter can be assumed to be integrally formed with first and second flange parts formed on both flanks of the shutter, and the integrally formed shutter can be assumed to be slidably engaged with an opening part formed in the frame part composing the plug housing.

Therefore, the shutter is housed in the frame part of the plug housing to be moved not fixed.

It can be assumed that the shutter is formed like a rectangular tube formed of a thin plate having slot grooves on its sides. There is some space between the frame part and the mounting board on which the male contacts are mounted; and the shutter moves to cover and uncover the male contacts via the space.

The structure of the shutter like this enables the plates composing the header part to be thinner, thereby allowing the mating receptacle to be reduced in size.

DETAILED DESCRIPTION OF THE PREFERRRED EMBODIMENT

The embodiments of the present invention will be described as follows, based on the drawings.

Figure 1:
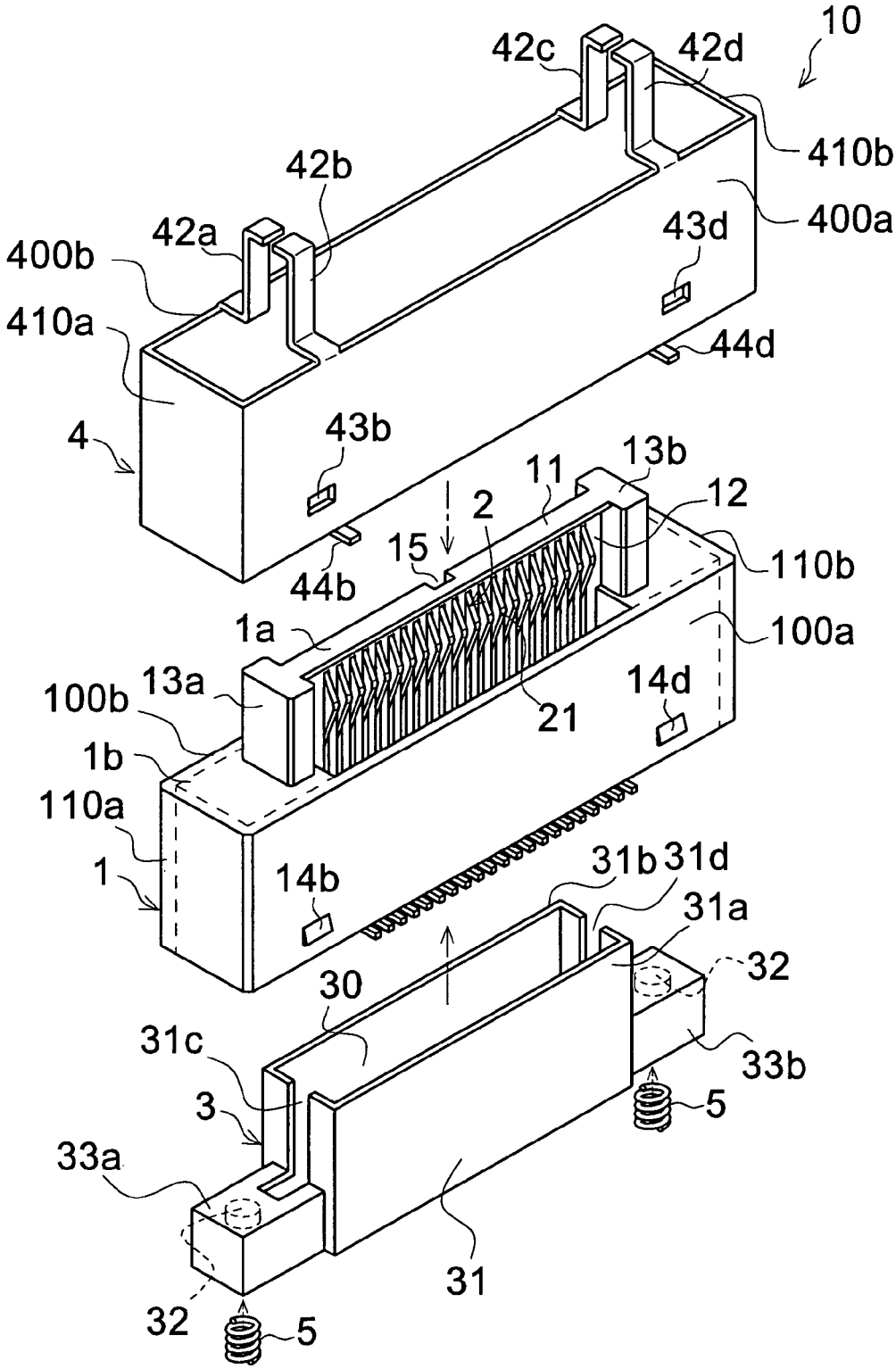
FIG. 1 is a perspective view showing the structure of an electric plug of an embodiment of the present invention.

FIG. 1 is a perspective view showing the structure of an electric plug of an embodiment of the present invention when partly disassembled. In the embodiment shown in FIG. 1, the electric plug 10 (hereinafter simply referred to as the plug 10) is composed of a plug housing 1, male contacts 2, a shutter 3, a shell 4, and a pair of compressed coil springs 5.

In the embodiment shown in FIG. 1, the plug housing 1 is made from an insulative material and has a header part 1*a* and a frame part 1*b*. The header part 1*a* and the frame part 1*b* are formed integrally, and the header part 1*a* protrudes from the frame part 1*b*.

The male contacts 2 are made of flexible leaf springs and each has a flexible top part 21. The male contacts 2 are arrayed in parallel on a mounting board 12 provided in the header part 1*a*. The mounting board 12 has two rows of parallel arrayed male contacts 2: one on a front surface and one on a rear surface of the mounting board 12. Two male contacts opposed to each other across the mounting board 12 are disposed so that their flexible top parts 21 are raised towards opposite directions to each other.

The frame part 1*b* is shaped like a square cylinder with a pair of long-side walls 100*a* and 100*b* opposed to each other and a pair of short-side walls 110*a* and 110*b* opposed to each other. In the frame part 1*b*, a face (top face) from which the header part 1*a* protrudes and a face (bottom face) opposed to the top face are opened. Through the bottom face of the frame part 1*b* is inserted the insulative shutter 3 to assemble the plug housing 1. A space exists between an inner side of the frame part 1*b* and the mounting board 12, and the shutter 3 is inserted into the space.

The shutter 3 is composed of a wall-shaped shutter part 31 which sandwiches the mounting board 12, and a first flange 33*a* and a second flange 33*b* formed on both flanks of the shutter part 31, the first and second flanges 33*a* and 33*b* being integrally formed with the shutter part 31 using an electric insulative material.

The flanges 33*a* and 33*b* are each shaped like a box with an open bottom and a top wall opposite to the bottom, and each of the top wall has a projection 32 for supporting one end of one of the compressed coil springs 5 inside thereof.

The shutter part 31 is composed of a first shutter wall 31*a* and a second shutter wall 31*b* opposed to each other across the mounting board 12, and an opening part 30 formed between the first and second shutter walls 31*a* and 31*b* so as to cover the plural male contacts 2. On both sides of the shutter part 31 are formed slot grooves 31*c* and 31*d* into which mounting board 12 is inserted.

The shutter 3 with the above-mentioned structure is slidably engaged within the frame part 1*b* of the plug housing 1.

The shell 4 is integrally formed by bending a metal thin plate, and assembled from upper of the plug housing 1 so as to cover the outer side of the frame part 1*b*. The compressed coil springs 5 which are elastic members are beforehand incorporated into the flanges 33*a* and 33*b* of the shutter 3, and after the shell 4 and the plug housing 1 are assembled, bottom edges of the shell 4 are partially bent to make ribs provided on the bottom edges of the shell 4, and the compressed coil springs 5 are disposed between the ribs and the projections 32 provided within the flanges 33*a* and 33*b*.

At the top of the header part 1*a* of the plug housing 1 is formed a cap-shaped top board 11, from which the mounting board 12 extends downward. Since the top board 11 is shaped like a roof, the top board 11 and the mounting board 12 are integrally formed to have a vertical cross section shaped like the letter T. On two surfaces of the mounting board 12 are formed shallow grooves in striped into which the male contacts 2 are buried.

Furthermore, in order to support the top board 11 and the mounting board 12, a pair of vertical supports 13*a* and 13*b* is formed on the frame part 1*b*. The top board 11, the upper part of the mounting board 12, and the vertical supports 13*a* and 13*b* form the header part 1*a* which is inserted into a mating receptacle.

On an outer surface of the long-side wall 100*a* of the frame part 1*b* are formed triangular projections 14*b* and 14*d*. Similarly, on an outer surface of the long-side wall 100*b* opposed to the long-side wall 100*a* is formed another triangular projection 14*a* (not illustrated) on the position opposed to the triangular projection 14*b*. Similarly, on the outer face of the long-side wall 100*b* is formed a triangular projection 14*c* (not illustrated) on the position opposed to the triangular projection 14*d*. These triangular projections 14*a* to 14*d* are provided to lock the later-described holes 43*a* to 43*d* of the shell 4.

Bent pieces 42*a* and 42*b* are formed on top of the shell and are opposed to each other, and each has a vertical cross section shaped like the letter S. Similarly, on top of the shell 4 are formed another bent pieces 42*c* and 42*d* which are opposed to each other and each has a vertical cross section shaped like the letter S.

A shell long-side wall 400*a* of the shell 4 covering the long-side wall 100*a* of the frame part 1*b* is provided with rectangular holes 43*b* and 43*d*. A shell long-side wall 400*b* of the shell 4 covering the long-side wall 100*b* is also provided with a hole 43*a* (not illustrated) opposed to the hole 43*b*, and a hole 43*c* (not illustrated) opposed to the hole 43*d*.

The area of the inner cross section of the shell 4 is formed slightly larger than that of the outer cross section of the frame part 1*b*, and the plug housing 1 and the shell 4 are assembled by inserting the shell down to the plug housing 1.

The bent pieces 42*a* and 42*b* cover the vertical support 13*a* in such a manner as to be slightly above the vertical support 13*a*. Similarly, the bent pieces 42*c* and 42*d* cover the vertical support 13*b* in such a manner as to be slightly above the vertical support 13*b*. The effects of the shell 4 and the bent pieces 42*a* to 42*d* will be described later.

The shell 4 is installed so as to be in tight contact with the frame part 1*b*. To be more specific, when the shell 4 is inserted into the plug housing 1 to some extent, the triangular projections 14*b* and 14*d* are engaged with the rectangular holes 43*b* and 43*d*, respectively. Similarly, the triangular projections 14*a* and 14*c* are engaged with the rectangular holes 43*a* and 43*c*, respectively.

Figure 2A:
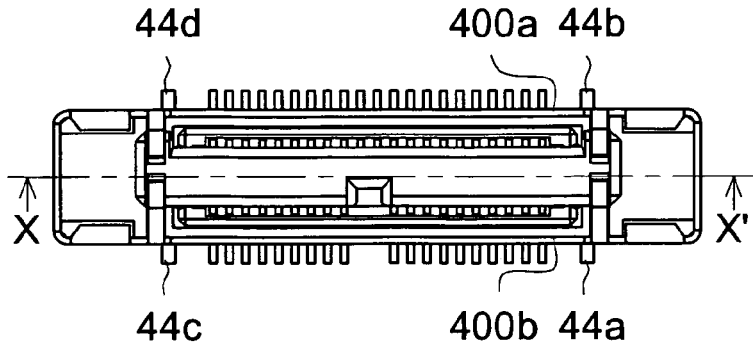
FIG. 2A is a front view of the electric plug when it is assembled.
Figure 2B:
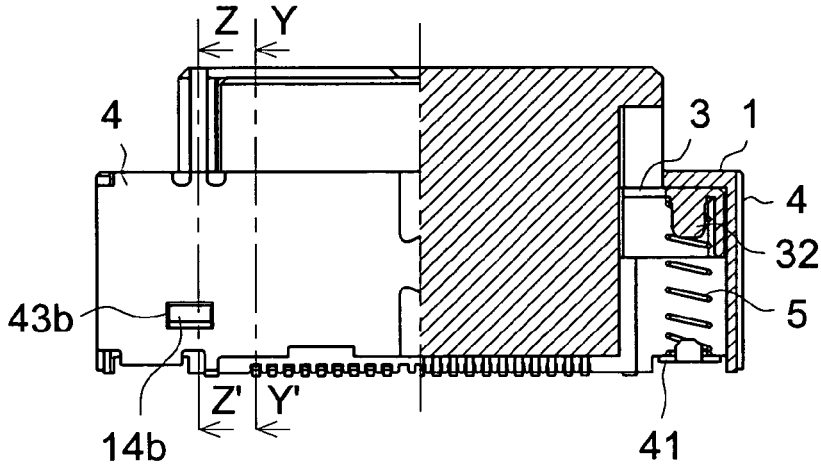
FIG. 2B is a plan view of the electric plug when it is assembled.
Figure 2C:
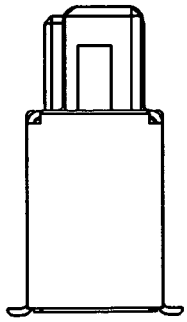
FIG. 2C is a side view of the electric plug when it is assembled.

The structure of the plug 10 in the present embodiment will be further explained as follows. FIG. 2A to FIG. 2C show the plug 10 when it is assembled; FIG. 2A is a front view, FIG. 2B is a plan view, and FIG. 2C is a side view. The right half of FIG. 2B is a cross sectional view taken along the line X–X' of FIG. 2A.

Figure 3A:
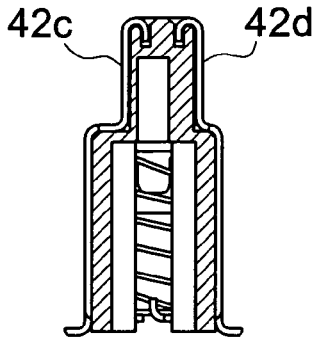
FIG. 3A is a cross sectional view of the electric plug taken along the line Z–Z' of FIG. 2B.
Figure 3B:
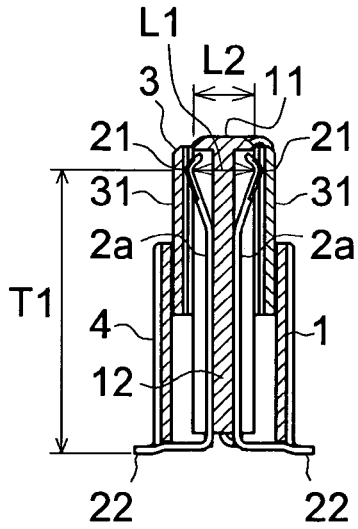
FIG. 3B is a cross sectional view of the electric plug taken along the line Y–Y' of FIG. 2B.
Figure 3C:
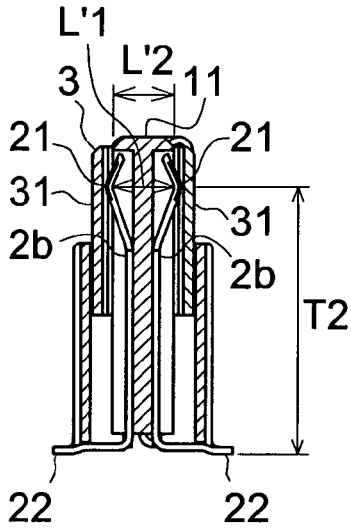
FIG. 3C is another cross sectional view of the electric plug taken along the line Y–Y' of FIG. 2B.

FIG. 3A is a cross sectional view taken along the line Z–Z' of FIG. 2B, and FIG. 3B and FIG. 3C are cross sectional views taken along the line Y–Y' of FIG. 2B. FIG. 3B and FIG. 3C show the male contacts 2, which are composed of long contacts 2*a* and short contacts 2*b* having a different length from each other. FIG. 3B shows the long contacts 2*a* and FIG. 3C shows the short contacts 2*b*.

As shown in FIG. 3B, the long contacts 2*a* composed of flexible leaf springs are held on the mounting board 12 in such a manner where the flexible top parts 21 of each pair of long contacts 2*a* opposed to each other across the mounting board 12 are raised towards opposite directions to each other. The long contacts 2*a* are arrayed in parallel and a pair of rows of paralleled long contacts 2*a* is opposed to each across the mounting board 12.

Similarly, as shown in FIG. 3C, the short contacts 2*b* made of flexible leaf springs are held on the mounting board 12 in such a manner where the flexible top parts 21 of each pair of short contacts 2*b* opposed to each other across the mounting board 12 are raised towards opposite directions to each other. The short contacts 2*b* are arrayed in parallel and a pair of rows of paralleled short contacts 2*b* is opposed to each across the mounting board 12.

The difference between the long contacts 2*a* and the short contacts 2*b* is the length from the positions of ends of respective legs 22 to the positions of the flexible top parts 21. Assuming that the length from the positions of the ends of the legs 22 of the long contacts 2*a* to the positions of the flexible top parts 21 is T1 and the length from the positions of the ends of the legs 22 of the short contacts 2*b* to the positions of the flexible top parts 21 is T2, T1 is longer than T2. In other words, the long contacts 2*a* have the longer length T1, whereas the short contacts 2*b* have the shorter length T2. The long contacts 2*a* are arrayed in an electrical power line, for example, and the short contacts 2*b* are arrayed in a signal line.

The long contacts 2*a* and the short contacts 2*b* are arrayed in parallel on the mounting board 12, and the pair of rows of the male contacts 2 is opposed to each other with the mounting board 12 disposed therebetween, thereby forming a multi-polar dual in-line.

As shown in FIG. 3B or 3C, the respective legs 22 of the paired male contacts 2 opposed to each other across the mounting board 12 extend towards opposite directions to each other from the plug housing 1. And the male contacts 2 arrayed on the same surface of the mounting board 12 are arranged in parallel. The legs 22 of the male contacts 2 can be fixed on a printed-circuit board (not illustrated).

As shown in FIG. 3B or 3C, the shutter part 31 of the shutter 3 covers both rows of the parallel arrayed male contacts 2 mounted on the both surfaces of the mounting board 12.

As shown in FIG. 2B, the compressed coil springs 5 which are elastic members are disposed in a pair in the plug housing 1. The inside of one end of each of the compressed coil springs 5 is inserted into the projection 32 in the flange 33*a* (or 33*b*) of the shutter 3, and the inside of the other end of each of the compressed coil springs 5 is inserted into a rib 41 formed by bending a part of the shell 4 which extends toward inside of the plug housing 1. In other words, the compressed coil springs 5 are arranged between the projection 32 in the shutter 3 and the rib 41 of the shell 4.

The compressed coil springs 5 make a force to push out the shutter 3 within the plug housing 1. In other words, the compressed coil springs 5 give a force to enable the shutter part 31 to move so as to cover each row of the parallel arrayed male contacts 2 arranged in pairs.

In addition, as shown in FIG. 2A, a pair of solderable tabs 44*b* and 44*d* is provided in opposite directions to each other at bottom edges of the shell long-side wall 400*a* of the shell 4. The solderable tabs 44*b* and 44*d* are to be fixed on a printed-circuit board. Similarly, a pair of solderable tabs 44*a* and 44*c* is provided in opposite directions to each other at bottom edges of the shell long-side wall 400*b* of the shell 4.

Figure 4:
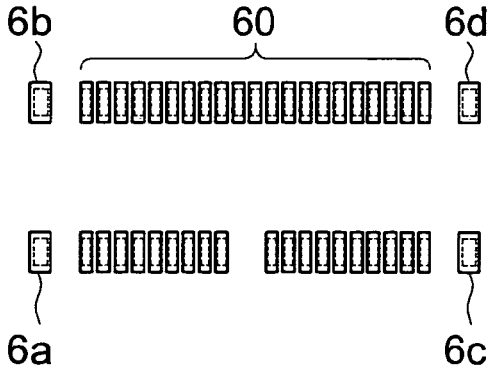
FIG. 4 is a pattern layout formed on a printed-circuit board on which to mount the electric plug.

FIG. 4 is a pattern layout showing the positioning pattern formed on the printed-circuit board on which to mount the plug 10. The pattern layout of FIG. 4 corresponds to the plug 10 shown in FIG. 1.

As shown in FIG. 4, the printed-circuit board has positioning patterns 6*a* to 6*d* to which the tabs 43*a* to 43*d* of the shell 4 are soldered, and a positioning pattern group 60 to which the final ends of the male contacts 2 are soldered. The male contacts 2 are fixed on the positioning pattern group 60 and soldered, like a surface mounting device, to the printed-circuit board with which the plug 10 is intended to be connected.

Figure 5:
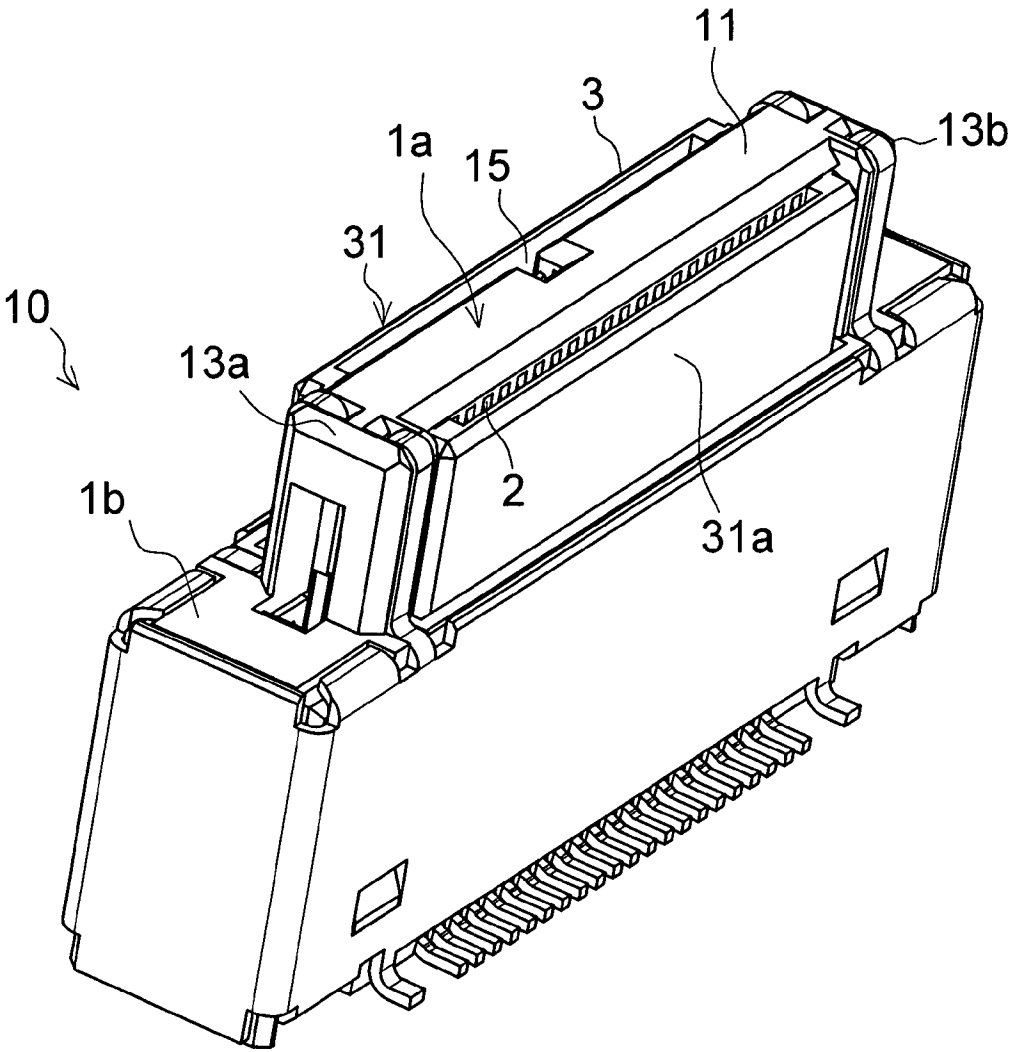
FIG. 5 is an external view of the electric plug showing the state where the shutter covers the contacts.
Figure 6:
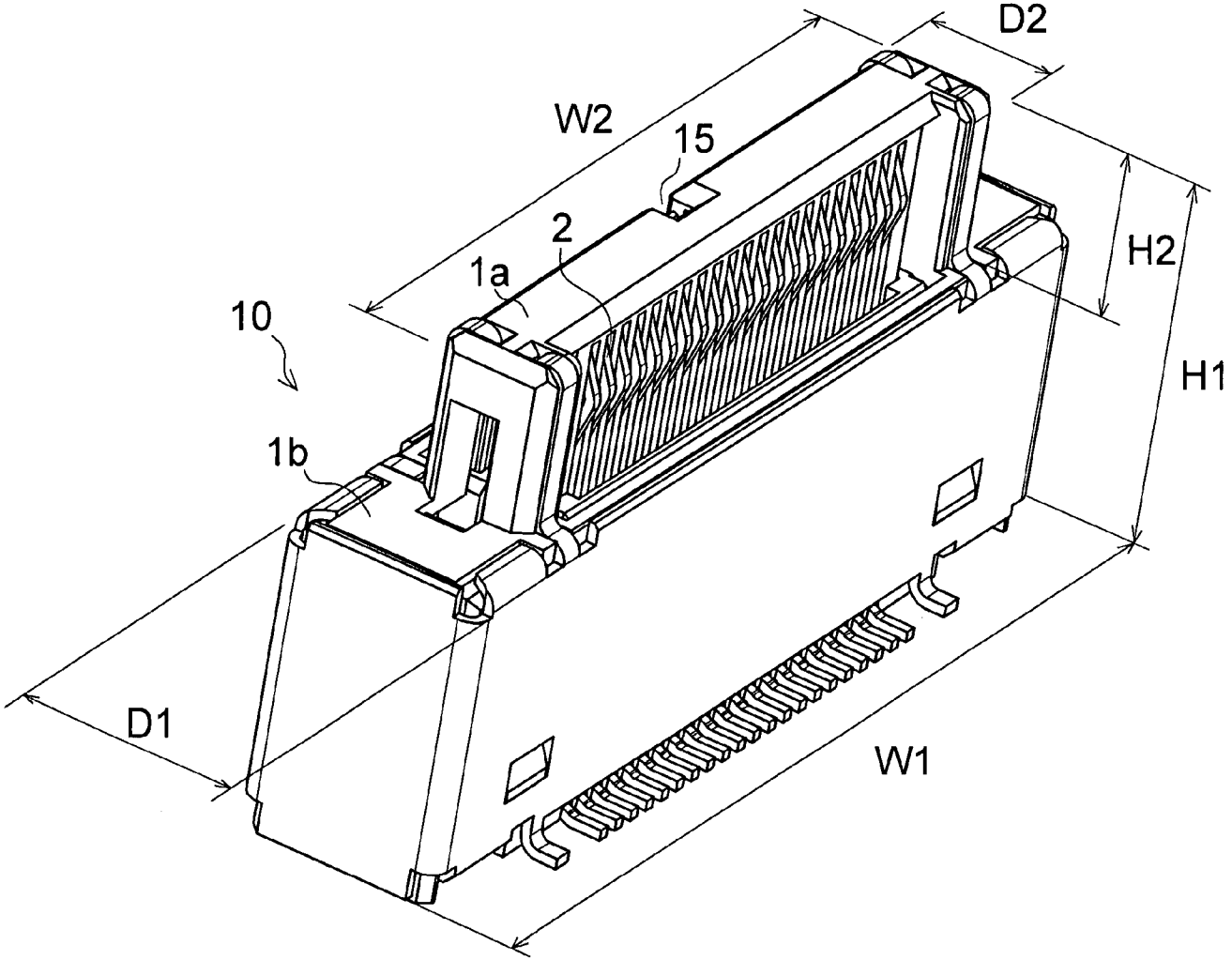
FIG. 6 is an external view of the electric plug showing the state where the shutter is housed in the frame part.

The following is a description of the effects of the present invention. FIG. 5 is an external appearance of the plug 10, showing the state where the plug 10 is not inserted into the mating receptacle. FIG. 6 is another external appearance of the plug 10, showing the state where the plug 10 is inserted into the mating receptacle.

FIG. 5 shows the shutter 3 covering the male contacts 2. In the state shown in FIG. 5, the male contacts 2 are covered with the top board 11 and the shutter part 31 so as to be protected from handling or dust as shown also in FIG. 3B and FIG. 3C. Also, dust adhesion on the male contacts 2 is reduced.

The length L1 between the flexible top parts 21 of the paired long contacts 2*a* opposed to each other across the mounting board 12 is made to be slightly larger than the length L2 of the vertical width of the top board 11 (FIG. 3B). Similarly, the length L1' between the flexible top parts 21 of the paired short contacts 2*b* opposed to each other across the mounting board 12 is made to be slightly larger than the length L'2 of the vertical width of the top board 11 (FIG. 3C). Therefore, the long contacts 2*a* and the short contacts 2*b* arrayed in pairs press female contacts of the mating receptacle providing a contact pressure to the mating receptacle.

The header part 1*a* including the top board 11 and the vertical supports 13*a* and 13*b* is inserted into the mating receptacle. There is a key groove 15 formed on the top board 11 to guide a proper inserting direction. The mating receptacle has an inserting opening, and when the plug 10 is inserted into the mating receptacle, an apex of each of the shutter part walls 31*a* and 31*b* comes into contact with front edge of the inserting opening.

When the plug 10 is inserted into the mating receptacle, the shutter walls 31*a* and 31*b* in contact with the front edge of the inserting opening cannot be inserted into the inserting opening of the mating receptacle, thereby being pushed back towards the frame part 1*b*. This causes the male contacts 2 to be exposed as shown in FIG. 6 and to press fixed female contacts of the mating receptacle, thereby making the male contacts 2 come into contact with the female contacts.

When the plug 10 is removed from the mating receptacle, the force caused by the compressed coil springs 5 moves the shutter 3 towards the top board 11, thereby returning the shutter 3 to the state of FIG. 5 in which the shutter 3 covers the male contacts 2.

Figure 7:
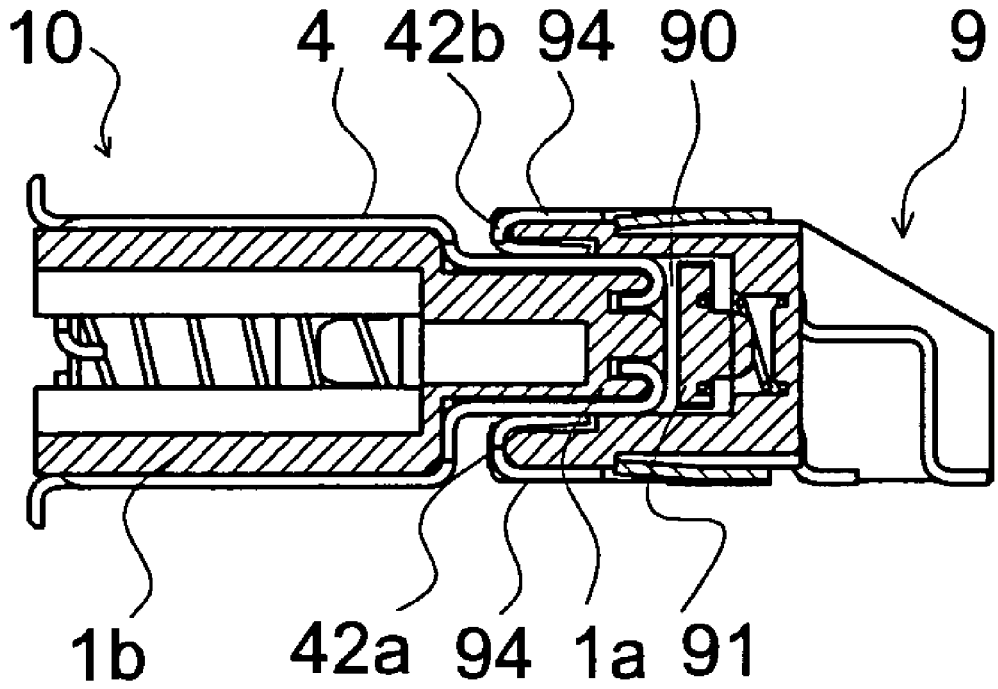
FIG. 7 is a cross sectional view of the state where the plug is inserted into a mating receptacle.

FIG. 7 is a cross sectional view showing the state where the plug 10 is inserted into the mating receptacle. In FIG. 7, the header part 1*a* of the plug 10 is inserted into the inserting opening 90 of the mating receptacle 9, and a receptacle shutter 91 provided in the receptacle 9 is pushed back by the header part 1*a* and retracted to the back of the inserting opening 90.

As shown in FIG. 1, the shell 4 formed of a metal thin plate covers the frame part 1*b* and partially protrudes to form the bent pieces 42*a* to 42*d* for partially covering the vertical supports 13*a* and 13*b* formed on both flanks of the header part 1*a*. On the other hand, in FIG. 7, the receptacle shell 94 made of a metal thin plate covers the receptacle housing, and at the same time, bends towards the inserting opening 90 in such a manner as to have a U-shaped cross section, thereby covering parts of inner walls surrounds the inserting opening 90.

In FIG. 7, the shell 4 made of a metal thin plate covers the frame part 1*b* to structurally reinforce it, and also shields the plug.

Also, since a part of the shell 4 protrudes to partially cover the header part 1*a*, a part of the header part 1*a* (vertical supports 13*a* and 13*b*) is covered with the metal plate composing the shell 4 even inside the inserting opening 90 of the mating receptacle 9. Therefore, when the plug 10 is inserted into the mating receptacle 9, the mating receptacle 9 and the plug 10 are integrally shielded.

Next, the relationship between the first and the second shutter wall 31*a* and 31*b* and the mounting board 12 of the plug housing 1 will be described as follows with the perspective view of FIG. 8.

Figure 8:
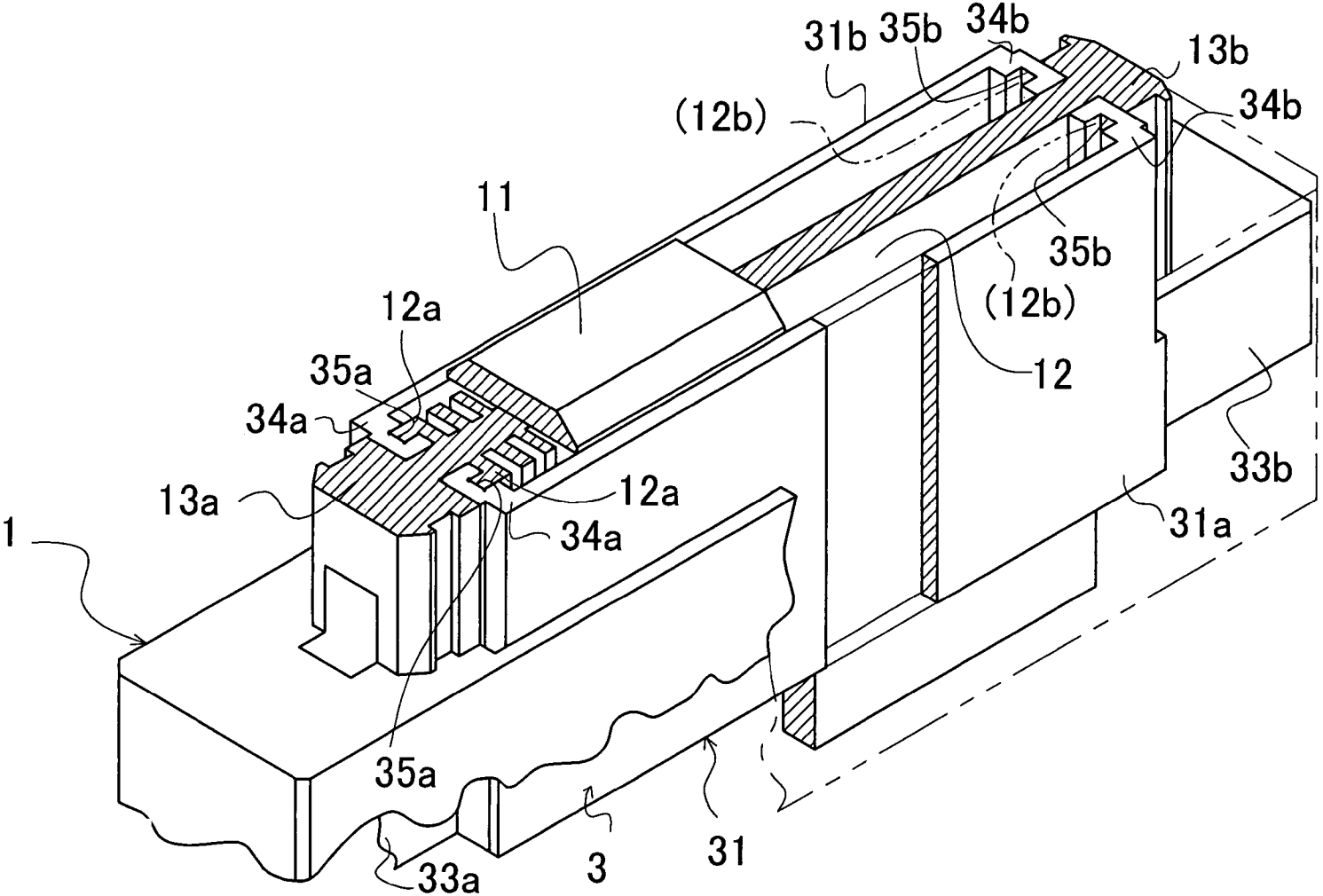
FIG. 8 is a perspective view showing the structure of the shutter.

As shown in FIG. 8, the shutter part 31 is provided with the first shutter wall 31*a* and the second shutter wall 31*b* opposed to each other with the mounting board 12 disposed therebetween.

On both flanks of the first shutter wall 31*a* are provided a pair of restricting frames 34*a* and 34*b*. Similarly, on both flanks of the second shutter wall 31*b* are provided a pair of restricting frames 34*a* and 34*b*. Each of the restricting frames 34*a* and 34*b* is provided with a U-shaped groove 35*a* or 35*b*.

On the other hand, the mounting board 12 is provided with a pair of L-shaped rails 12*a* and 12*b* formed on both flanks in the width direction of the surface on which to mount the male contacts 2 (See FIG. 1). The pair of rails 12*a* and 12*b* is provided on each of the two surfaces of the mounting board 12, so the mounting board 12 has two pairs of rails or a total of four rails.

As described above, the shutter 3 is assembled by being inserted from the bottom of the plug housing 1, and as shown in FIG. 8 the pairs of L-shaped rails 12*a* and 12*b* are engaged with the pairs of grooves 35*a* and 35*b*, respectively.

This combination of the first and second shutter walls 31*a* and 31*b* and the mounting board 12 of the plug housing 1 secures parallel movement of the shutter 3, and the pairs of rails 12*a* and 12*b* prevent the shutter 3 from being easily opened.

As described with FIG. 4, the plug 10 is mounted on the surface of the printed-circuit board which is installed in a cradle. This realizes an electric connection plug for miniature multi-polar cradles.

Furthermore, the printed-circuit board can be covered with a cable shell and electrically connected with the cable shell via a cable to provide an electric connection plug for cable connection.

The electric plug of the present invention thus directly engages the receptacle connector provided on the electric device with the plug connector provided on the cradle, without increasing the number of components of the cradle. The electronic device having a receptacle capable of being connected with the electric plug of the present invention can be reduced in size, at least without regard to of the external shape of the receptacle.

Also, in the embodiment shown in the perspective view of FIG. 6, the plug 10 has a lateral width W1 of 19.6 mm, a depth D1 of 4.1 mm, and a height H1 of 9.5 mm. The projecting part of the plug 10 has a lateral width W2 of 14.7 mm, a depth D2 of 2.4 mm, and a height H2 of 3.2 mm. The contacts 2 have a pitch of 0.5 mm and 42 poles; however, two poles become unusable (not contactable) because of the key groove 15, so the substantial number of poles is 40.

The electric plug of the present invention can protect the male contacts from dust or handling because the male contacts made of flexible leaf springs are covered by the shutter made of a thin plate when the plug is not connected with the mating receptacle.

Also, when the electric plug is connected with the mating receptacle, the shutter is pushed by the mating receptacle and retracted, making the plural male contacts exposed, thereby connecting the male contacts of the electric plug with the fixed female contacts of the mating receptacle.

Covering the male contacts with the thin plate shutter in this manner eliminates the need for the formation of an insulative cover housing to cover the male contacts, thereby realizing miniaturization of the electric plug or the mating receptacle.

Also, the electric plug of the present invention can be used for cradles and cables, and can further be used for printed-circuit boards and printed-circuit board connections, thereby resulting in a miniature dustproof plug with a wide application.

What is claimed is:

1. An electric plug comprising:

an insulative plug housing having a frame part and a header part formed integrally with the frame part, the header part protruding from the frame part and for being inserted into a mating receptacle;

male contacts of flexible leaf springs, each male contact having a flexible top part; and a shutter covering the male contacts when the header part is removed from the mating receptacle and is housed in the frame part by being pushed by the mating receptacle wherein the header part has a mounting board protruding outside of the frame part, wherein the male contacts are arrayed in parallel on both surfaces of the mounting board, wherein a pair of the flexible top parts of the male contacts opposed to each other with the mounting board disposed therebetween are raised towards opposite directions to each other and wherein the shutter has a first shutter wall and a second shutter wall which are opposed to each other and are parallel to the mounting board so as to cover the male contacts when the header part is removed from the mating receptacle and to expose the male contacts when the header part is inserted into the mating receptacle.

2. The electric plug according to claim 1 further comprising an elastic member for pushing out the shutter to cover the male contacts when the header part is removed from the mating receptacle.

3. The electric plug according to claim 1, wherein the mounting board has a top board, a distance between the flexible top parts opposed to each other with the mounting board disposed therebetween is slightly larger than a width of the top board to make respective ones of the male contacts press respective ones of female contacts of the mating receptacle.

4. The electric plug according to claim 2, wherein the mounting board has a top board, a distance between the flexible top parts opposed to each other with the mounting board disposed therebetween is slightly larger than a width of the top board to make the respective ones of the male contacts press respective ones of female contacts of the mating receptacle.

5. The electric plug according to any one of claims 1 to 4, wherein legs of the male contacts opposed to each other with the mating board disposed therebetween extend from the header part towards opposite directions to each other to be fixed on a printed-circuit board.

6. The electric plug according to any one of claims 1 to 4 further comprising:

a shell for covering the frame part; and pairs of soldering tabs arranged on edges of the shell to be fixed on the printed-circuit board.

7. The electric plug according to any one of claims 1 to 4, wherein a shell is formed of a metal thin plate, covers the frame part and has protruding pieces to cover a part of the header part.

8. The electric plug according to any one of claims 1 to 4, wherein each of the first shutter wall and the second shutter wall has a pair of restricting frames on both flanks thereof;

each of the restricting frames has a groove, each of the surfaces of the mounting board for mounting the male contacts is provided with a pair of rails on opposite edges of the surface, and the rail is engaged with the groove in such a manner where the shutter can move back and forth.

9. A receptacle capable of being connected with the electric plug according to any one of claims 1 to 4.

* * * * *